United States Patent [19]

Properzi

[11] 3,987,657

[45] Oct. 26, 1976

[54] ROLL SETTING DEVICE FOR ROLLING MILLS FOR METAL BARS OR THE LIKE

[76] Inventor: Giulio Properzi, Via Pietro Cossa, 1, Milan, Italy

[22] Filed: June 27, 1975

[21] Appl. No.: 591,228

[30] Foreign Application Priority Data

July 18, 1974 Italy ..... 25324/74

[52] U.S. Cl. ..... 72/247; 72/224

[51] Int. Cl.[2] ..... B21B 31/20

[58] Field of Search ..... 72/247, 224, 249, 32-

[56] References Cited

UNITED STATES PATENTS

| | | | |
|---|---|---|---|
| 1,478,772 | 12/1923 | Stiefel | 72/247 |
| 1,899,659 | 2/1933 | Asbeck | 72/224 |
| 1,930,698 | 10/1933 | Stiefel | 72/247 X |
| 3,142,208 | 7/1964 | Properzi | 72/224 |
| 3,380,278 | 4/1968 | Dilling | 72/224 |
| 3,429,167 | 2/1969 | Sieurin et al. | 72/247 |

*Primary Examiner*—Milton S. Mehr
*Attorney, Agent, or Firm*—Guido Modiano; Albert Josif

[57] ABSTRACT

The invention relates to a rolling arrangement for rolling mills including means for continuously centering the rolls with respect to the product being rolled and for adjusting the pass defined by the rolls. A roll is mounted with its shaft on a cylindrical support which is displaceable within the frame of the rolling unit and comprises an outer threaded portion engaging with an annular threaded element whose rotation causes axial displacement of the support and of the shaft and the roll, thus allowing continuous centering thereof. Setting shims are provided between a cover of the structure supporting the roll and the frame of the rolling unit for adjustment of the pass defined by the rolls. Adjustment of the clearance of the two bearings supporting the roll shaft is obtainable by providing each of the outer rings of the bearings with the outer threaded portion and the threaded annular element and separately actuating the same.

5 Claims, 4 Drawing Figures

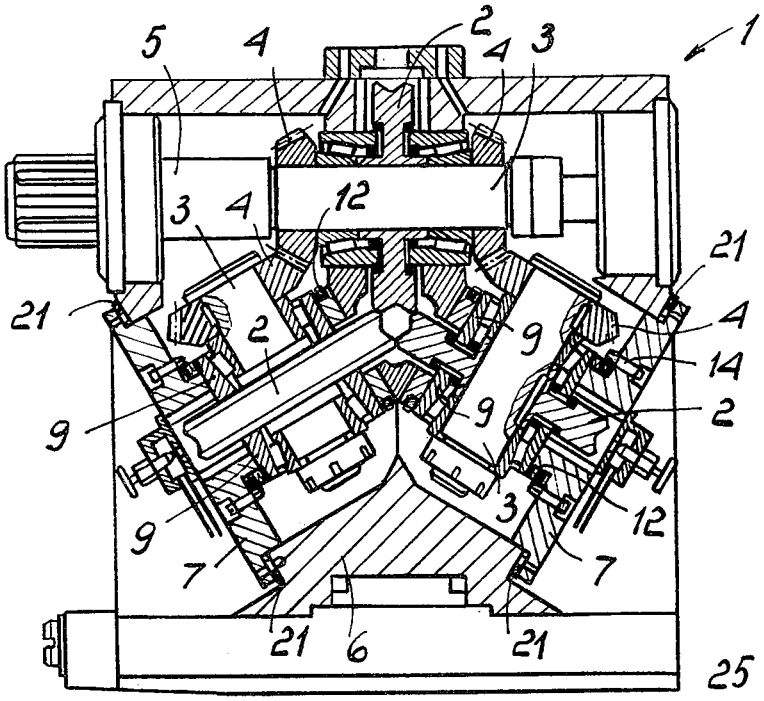
Fig. 1
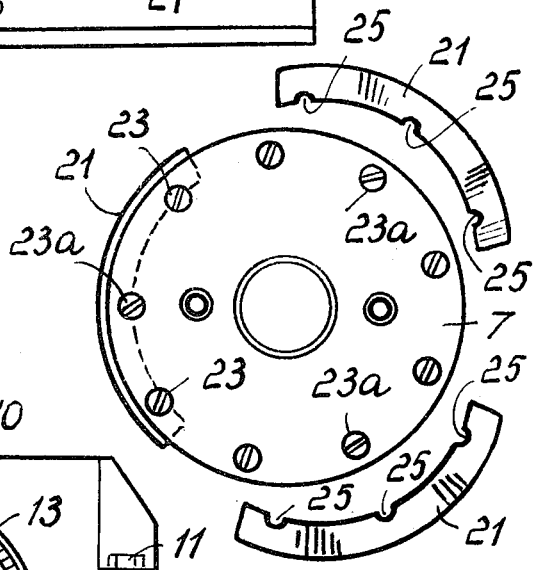
Fig. 4
Fig. 3
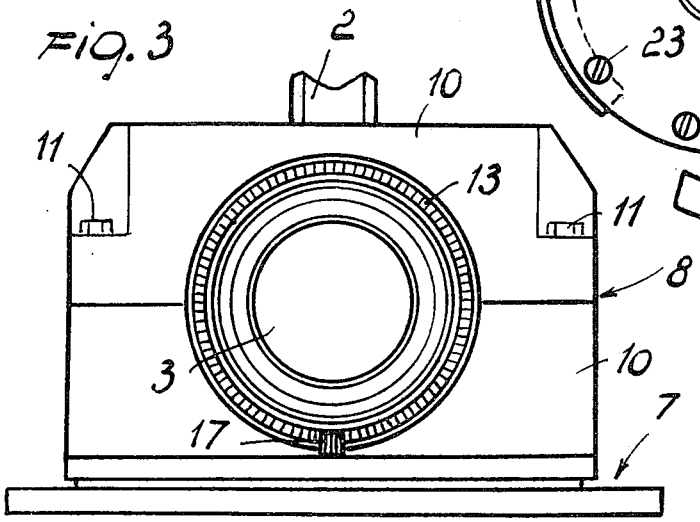

ROLL SETTING DEVICE FOR ROLLING MILLS FOR METAL BARS OR THE LIKE

BACKGROUND OF THE INVENTION

This invention relates to a roll setting device for rolling mills for metal bars or the like.

In rolling mills for metal bars or rods, the rolls must notably be carefully set before rolling, this operation comprising centering the rolls and setting the pass between the rolls and the clearance of the bearings. The operation results in long assembly time, as the maximum care must be taken in assembly because even small dissymmetry in the passage section or any displacement in the shape of the section from that theoretically determined leads to considerable difficulties, the most important of which is torsion in the bar or rod being produced.

This torsion leads to an increase in the power required in the individual rolling units and to a product comprising internal stresses and non-uniformity of structure, which make the product one of inferior quality unsuitable for subsequent drawing.

The proper operation of the rolling mill requires that certain rigorous geometrical conditions of mutual positioning of the working surfaces of the rolls, between which the pass is defined for the product to be rolled, be satisfied during assembly. These conditions are that the roll axes must be coplanar, the plane common to the roll axes must be perpendicular to the axis of rolling, and the cross-section of the passage must be symmetrical about the point of intersection of the axis of rolling with the plane defined by the roll axes.

Two operations are required during assembly to make the passage cross-section symmetrical, i.e. centering the rolls and adjusting the pass. In practice, these operations involve setting the rolls to obtain tangency between the rolling surfaces and a circle with its centre at the axis of rolling and of determined diameter, this diameter strictly depending on the position which the rolling unit concerned occupies in the rolling sequence. In this respect, to avoid traction or compression of the metal being rolled, the ratio of the areas of two successive passes must exactly correspond to that determined at the design stage, and as this ratio is the result of much theoretical or practical study, strict setting of the pass of each rolling unit is essential for proper operation.

The said centering of the rolls and adjusting of the pass are attained in practice by moving the rolls in two directions in the common plane of the axes which must be perpendicular to the axis of rolling, one of these directions coinciding with the roll axis, and which is used for centering, and the other being perpendicular to the roll axis, and which is used for adjusting the pass.

These adjusting operations become more complicated and laborious in terms of assembly times when the rolling unit comprises three rolls disposed at 120°.

At present these units are constructed in such a manner that the said setting is done by placing shims between roll support parts and the frame block structure. In particular, units have been made in which two of the roll support shafts, complete with bearings and shim, are mounted in two housings extractable from the frame block, the shims being placed between the support surfaces of the frame block and the housing, and between the bearings and the housing, respectively. Setting is carried out by varying these shims as required, those between the support surfaces of the frame block and housing being varied for adjusting the pass and those between the bearings and housing for adjusting the centering and the clearance of the bearings.

This system however presents considerable disadvantages in terms of the time necessary for setting up the rolling unit. This setting up involves the following successive operations: initial assembly with approximate shims, measurement of the centering and pass to determine the correct size of the shims on the basis of these measurements, dismounting the unit including the housings, replacing the shims with those determined by the measurements made, and further reassembly which may be subject to further satisfactory checking before the rolls are finally set.

It is evident that a succession of operations of this type, which have to be carried out for each successive rolling unit of a rolling mill and comprising a different calculation each time of the required shims, lead to an extremely long setting-up and consequently unproductive time for the rolling mill.

The fundamental object of the present invention is to provide a device for setting the rolls of rolling mills for metal bars or the like, with which it is possible to make roll setting more immediate and easy, and at the same time improving setting accuracy with respect to the accuracy obtainable by known devices.

A further object of the present invention is to provide a device so constructed that the rigidity of that part of the structure most directly stressed mechanically is increased, to the advantage of the length of time for which the settings may be maintained.

SUMMARY OF THE INVENTION

These objects are attained by a roll setting device for rolling mills for metal bars or the like, wherein at least one of the rolls is arranged on a support structure removably mounted on the rolling mill, the device being structured so that said roll is supported by support means movable relative to said support structure, said means being operatively connected to control means accessible from the outside of the rolling mill for continuously moving said support means and said roll with respect to the product being manufactured during the actuation of said control means.

According to one advantageous embodiment of the invention, in which the support means consist of a shaft carrying the roll and a pair of bearings disposed between the shaft and support structure, the support structure comprises at least one annular element rotatably associated with it and disposed coaxially to the shaft, the annular element comprising an inner thread engaging with a thread provided on the outer ring of the bearings, and an outer toothing disposed in a plane substantially perpendicular to the axis of the shaft and engaging with a pinion disposed at one end of an operating member, the other end of which is accessible from the outside of the support structure, in such a manner that by rotating this operating member the annular element rotates and the roll moves in the direction of the axis of the shaft carrying said roll.

An embodiment of this type allows setting of the roll in the direction of its axis, i.e. centering, by a single operation which can be carried out on the whole of the assembled unit, without it being necessary to first make a provisional setting and then dismount the unit to then reassemble it with other shims. Thus not only a more rapid and easy setting is obtained, but also a more precise setting, because adjustments can be made over infinitesimal distances, not possible with shims. By disposing suitably graduated scales, it is possible to make a direct reading of the setting of the assembled unit.

Advantageously, two annular elements are provided on opposite sides of the roll, each engaging with one of the two bearings supporting the roll shaft. In this way it is also possible to set the clearance of the bearings, as these can be operated independently by rotating the respective annular elements controlled by respective control means.

The pass is adjusted by disposing shims, these being housed advantageously between the cover which fixes the support structure to the frame block and the frame block itself. This arrangement allows the shims to be rapidly replaced by others of different size without having to dismount the entire roll housing, but simply by slackening the fixing means for the cover and slightly moving the cover outwards by a sufficient amount to insert the shims between the cover and frame block.

BRIEF DESCRIPTION OF THE DRAWINGS

Further characteristics and advantages will be more evident from the description given hereinafter of a preferred embodiment of the invention with reference to a device for setting the rolls in a rod rolling mill, illustrated in the accompanying drawings in which:

FIG. 1 is a vertical section through a rolling unit provided with the device according to the invention;

FIG. 3 is an elevational view of a housing with rolls according to the invention; and FIG. 4 shows the support structure cover and the shims provided for adjusting the pass.

DESCRIPTION OF THE PREFERRED EMBODIMENT

Figure 2:
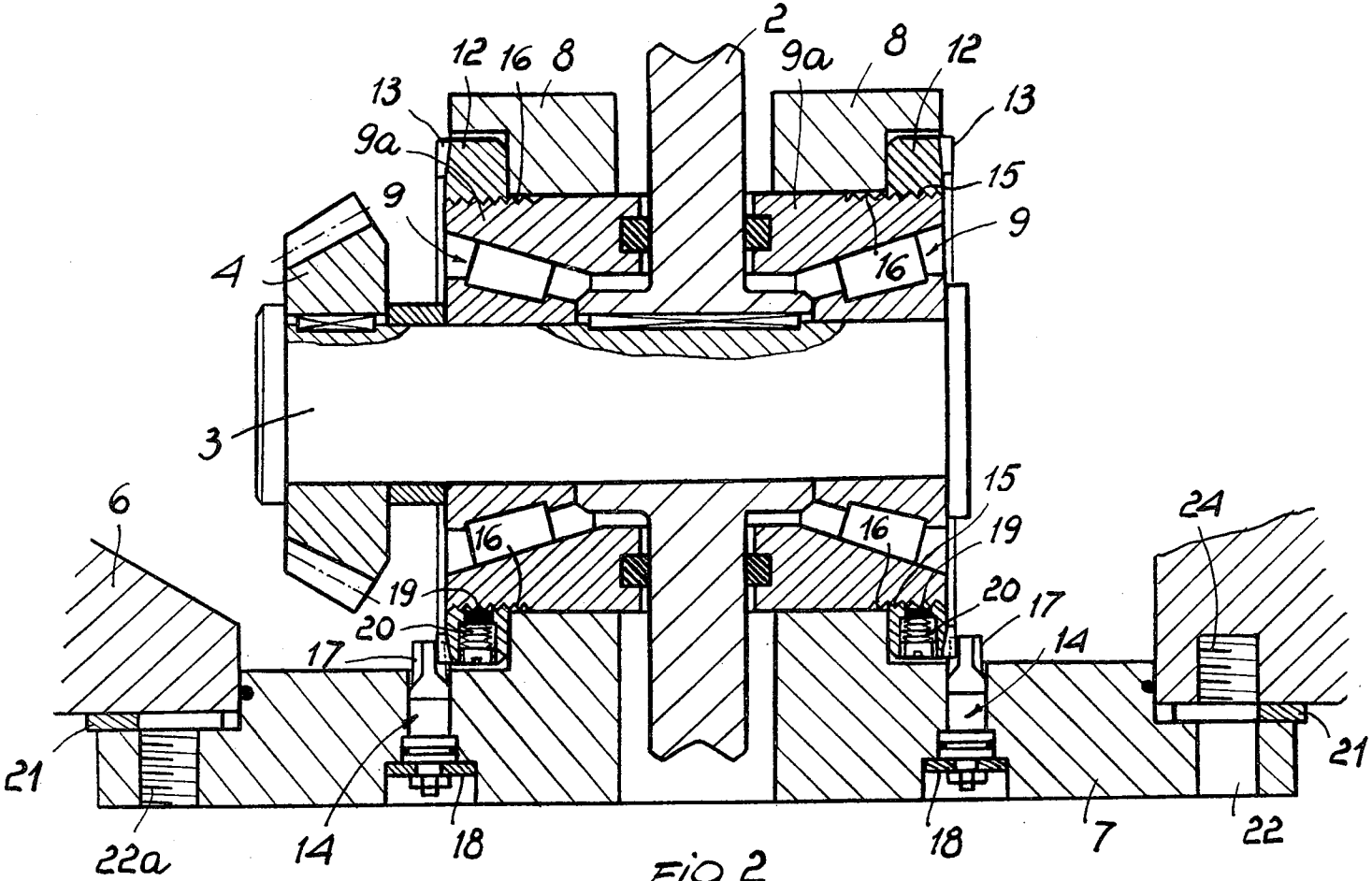
FIG. 2 is an axial section to an enlarged scale through the roll support structure and the device according to the invention.

FIG. 1 shows a rolling unit 1 comprising, in known manner, three rolls 2 disposed at 120° to each other on respective shafts 3. These are rotated through bevel gears 4 by the drive shaft 5 connected to the rolling mill drive means, not shown. The pass is defined by the space between the grooves of the rolls 2.

The oblique rolls are mounted, together with their shafts, on a support structure extractable from the frame block 6 forming the rolling unit. This support structure consists, according to the invention, of a plate or cover 7 and two sides 8 perpendicular to it, which define the seats for the bearings 9 supporting the shaft 3. Advantageously the sides 8 are formed in two halves 10 (FIG. 3) arranged on opposite sides of the axis of the shaft 3 and removably connected together by screws 11, so as to make it possible to disassemble the unit formed by the roll 2, shaft 3 and bearings 9. This embodiment also has the advantage of considerable rigidity. The support structure is fixed to the frame block by the cover 7, as will be described hereinafter.

According to the invention, the support structure comprises at least one annular element 12 rotatably associated with it and comprising an outer toothing 13 for engagement with corresponding toothed control means 14 accessible from the outside of the support structure fixed to the frame block 6, and an inner thread 15 engaged with an outer thread 16 provided on the support means for the shaft 3. In the embodiment shown by way of example, the annular element 12 is disposed coaxially to the shaft 3 and its inner thread 15 engages with an outer thread 16 provided on the outer ring 9*a* of the bearings, while the outer toothing 13 is disposed in a plane substantially perpendicular to the axis of the shaft 3 and engages with a pinion 17 provided on the control means 14. The pinion 17 is disposed at one end of an operating pin rotatably housed in the cover 7 and comprises at its other end a head 18 of hexagonal or other shape, accessible from the outside of the cover 7 for engagement by a tool or the like.

Advantageously two of these annular elements 12 are provided, disposed on opposite sides of the roll 2, and operated independently by corresponding operating means 14.

The operating principle of the device described is easy to understand. When the head 18 of the operating pin is rotated, the pinion 17 rotates and with it the annular element 12, this rotation resulting in a movement of the bearing 9 in a direction parallel to the axis of rotation of the roll 2. As the bearing 9, shaft 3 and roll 2 are mutually constrained, a movement of the roll 2 is obtained in the direction necessary for centering the roll. A graduated scale may be disposed at the head 18, the scale being preferably calibrated in accordance with the linear movement of the bearing 9 corresponding to a given angle of rotation of the pinion 17.

In practice, as two setting units are provided, the two pinions 17 are operated simultaneously in a direction which gives a concordant movement of the two bearings 9 to position the roll 2 in the exact centered position, then the pinions 17 are operated in a direction which gives discordant movement of the bearings 9 to exactly set the clearance between the bearings 9 and roll 2.

It can be seen that centering and bearing clearance setting are carried out directly on the completely assembled unit and are extremely fine and easy.

The present embodiment also takes account of the need for dismantling the unit for replacing the rolls 2, which could require a new setting operation if any accidental rotation of the annular element 12 results during dismantling. To avoid this, a plurality of brakes 19 is provided, preferably in the form of small brake blocks of plastics material, which are resiliently pressed against the outer thread 16 of the bearings 9 by a spring 20 housed in the annular element 12, and make any accidental rotation of the annular element 12 about the bearing 9 improbable during the removal of the support structure for replacing the roll.

The adjustment of the pass, which adjustment is done in a direction perpendicular to the axis of the roll 2, is obtained according to the invention by providing setting shims 21 removably insertable between the cover 7 of the support structure and the corresponding surface of the frame block 6. In changing the shims 21, the cover 7 and hence the support structure rigid with it are not completely removed from the frame block but are only partially removed from it by the amount sufficient to insert the shims between the cover and frame block. For this purpose the cover 7 comprises a plurality of through holes 22 for fixing screws 23 screwable into corresponding threaded holes 24 in the frame block 6, and some through holes 22*a* for support screws 23*a* which however do not have corresponding holes in the frame block but instead rest by one end on the frame block surface. To remove the cover from the frame block, the fixing screws 23 are firstly partially unscrewed and then the support screws 23*a* are screwed on, and these, pressing against the frame block, progressively remove the cover so creating space for inserting the shims 21.

The shims 21 are advantageously in the shape of an arc of a circle (FIG. 4) and comprise notches 25 for partially embracing the screws 23 and 23*a* without interfering with them and enable the shims to be withdrawn without removing the screws. The illustrated embodiment shows three shims, but their number may be different.

With the device described, both the centering of the rolls and the adjustment of the pass, is obtainable very rapidly, without it being necessary to remove the roll support structure.

The described device may be applied not only to the two oblique rolls of the rolling mill, but also to the horizontal roll if provision is made for detaching the shaft 3 from the drive shaft 5 to allow relative movement between the two shafts. The device may evidently be applied to units with only two rolls.

I claim:

1. A roll setting device for rolling mills for metal bars or the like, in which at least one of the rolls is arranged on a support structure removably mounted on the rolling mill and in which said roll is supported by support means movable relative to said support structure, said support means comprising a roll supporting shaft and a pair of bearings disposed between the shaft and said support structure, and said support structure comprising at least one annular element rotatably associated therewith and disposed coaxially to said shaft, said annular element comprising an inner thread for engagement with a thread provided on an outer ring of said bearings and an outer toothing arranged in a plane substantially perpendicular to the axis of said shaft, the device further comprising at least one control member having one end provided with a pinion for engagement with said toothing and another end accessible from the outside of said support structure, whereby rotation of said control member causes rotation of said annular element and movement of said roll in the direction of the axis of said shaft.

2. A device as claimed in claim 1, comprising two of said annular elements arranged on opposite sides of said roll, each of said annular elements engaging with a corresponding bearing and being operable independently of the other annular element.

3. A device as claimed in claim 1, further comprising at least one brake block resiliently engageable with said thread of said bearings during the removal of said support structure.

4. A device as claimed in claim 1, wherein said support structure consists substantially of a plate with two ribs arranged perpendicular thereto and supporting said bearings, said ribs being divided into two parts arranged on opposite sides of the axis of said shaft and removably connected together.

5. A device as claimed in claim 1, wherein said support structure comprises a cover with a plurality of seats for receiving means for removably mounting said support structure to said frame, said cover being partially removable from the frame of the rolling mill for the insertion of setting shims for pass line adjustment, said shims having notches so as not to interfere with said means.

* * * * *